United States Patent [19]

Sawada

[11] Patent Number: 4,809,414

[45] Date of Patent: Mar. 7, 1989

[54] APPARATUS FOR MANUFACTURING BIDIRECTIONALLY OPENABLE SLIDE FASTENERS

[75] Inventor: Toshiaki Sawada, Toyama, Japan

[73] Assignee: Yoshida Kogyo K. K., Tokyo, Japan

[21] Appl. No.: 120,544

[22] Filed: Nov. 13, 1987

[30] Foreign Application Priority Data

Nov. 14, 1986 [JP] Japan ..... 61-271106

[51] Int. Cl.[4] ..... B23P 19/04; A41H 37/06

[52] U.S. Cl. ..... 29/33.2; 29/408; 29/768

[58] Field of Search ..... 29/33.2, 766, 768, 409, 29/408

[56] References Cited

U.S. PATENT DOCUMENTS

| | | | |
|---|---|---|---|
| 2,287,507 | 6/1942 | Antonietta | 29/33.2 |
| 3,570,104 | 3/1971 | Jensen | 29/766 |
| 3,945,103 | 3/1976 | Fujisaki et al. | 29/408 |
| 4,217,685 | 8/1980 | Jeki | 29/408 |
| 4,325,982 | 4/1982 | Gillette et al. | 427/32 |
| 4,625,398 | 12/1986 | Kando | 29/768 |
| 4,627,807 | 12/1986 | Kuse | 425/116 |
| 4,650,091 | 3/1987 | Jassa et al. | 221/220 |

FOREIGN PATENT DOCUMENTS 60-236604 11/1985 Japan .

*Primary Examiner*—Gil Weidenfeld
*Assistant Examiner*—Daniel W. Howell
*Attorney, Agent, or Firm*—Hill, Van Santen, Steadman & Simpson

[57] ABSTRACT

In an apparatus for manufacturing a bidirectionally openable slide fastener, a guide unit is disposed between a pair of spaced first and second slider attachment units for holding taut an individual slide fastener length between the guide unit and a chain gripper even when the individual slide fastener length is severed from a slide fastener chain after the threading of a first slider on the first slider attachment unit but before the threading of a second slider on the second slider attachment unit. With this guide unit, the individual slide fastener length is tensioned properly, so that the second slider can be smoothly and reliably threaded over the slide fastener length.

5 Claims, 4 Drawing Sheets

APPARATUS FOR MANUFACTURING BIDIRECTIONALLY OPENABLE SLIDE FASTENERS

BACKGROUND OF THE INVENTION

1. Field of the Invention

This invention relates to improvements in and relating to an apparatus for automatically applying pairs of sliders onto a continuous slide fastener chain for the manufacture of bidirectionally openable slide fasteners.

2. Prior Art

A class of slide fasteners are known for use on bags, clothing and other garment articles which are designed to be opened and closed optionally in either direction. To this end, such slide fasteners are equipped with two sliders arranged symmetrically in either head-to-head or heel-to-heel confronting relation. There have been proposed a variety of apparatus for automatically applying sliders at predetermined intervals onto product lengths of a slide fastener chain. A typical example of such apparatus, as disclosed in Japanese Patent Laid-open Publication No. 60-236604, has a machine table defining thereon a path of feed of a slide fastener chain extending from an input end to an output end between which are disposed various operating units including a cutter for severing the fastener chain into individual product lengths, a pair of slider attaching units spaced a predetermined distance apart from each other and a reciprocating gripper driving the fastener chain from the input to the output end of the path. This apparatus is satisfactory in handling slide fastener stringers of relatively large product lengths such that the cutter is still at rest when the second slider is being assembled. However, with smaller product fastener lengths, the cutter begins to operate and cut the fastener chain which has been assembled only with the first slider with the result that the fastener length thus cut is apt to sag at its trailing end and lose tension, which would in turn make it difficult for the second slider attaching unit to apply the second slider smoothly in the correct position on the fastener.

SUMMARY OF THE INVENTION

With the foregoing difficulties in view, the present invention seeks to provide an apparatus for manufacturing a bidirectionally openable slide fastener having a pair of sliders, which apparatus incorporates means of maintaining a proper tension in a given product fastener length of a continuous slide fastener chain during assembling of the second slider thereon so that the second slider can be applied smoothly and accurately in position on the slide fastener.

According to the present invention, the foregoing and other objects are attained by an improved apparatus for manufacturing a bidirectionally openable slide fastener, of the type having a chain gripper reciprocably movable between an input end and an output end of said apparatus for feeding each individual fastener length of a continuous slide fastener chain along a feed path extending between the input and output ends, a cutter unit for cutting off the individual slide fastener length from the slide fastener chain, and a pair of spaced first and second slider attachment units for threading a pair of first and second sliders, respectively, over the individual slide fastener length, all the units being disposed in the feed path in the order named as viewed from the input end, the improvement which comprises a guide unit disposed in the feed path between the first and second slider attachment units for holding taut the individual slide fastener length as the latter is advanced along the feed path by the chain gripper.

With the apparatus thus constructed, the individual slide fastener length loses tension and sags at its trailing end when it is severed by the cutting unit after the threading of the first slider but prior to the threading of the second slider. However, the individual slide fastener length is held taut on the feed path between the guide unit and the chain gripper, so that the second slider can be smoothly and reliably threaded over the individual slide fastener length as the latter is further advanced under tension.

The above and other objects and features will be better understood from the following detailed description taken in connection with the accompanying drawings.

DETAILED DESCRIPTION OF THE INVENTION

Figure 1:
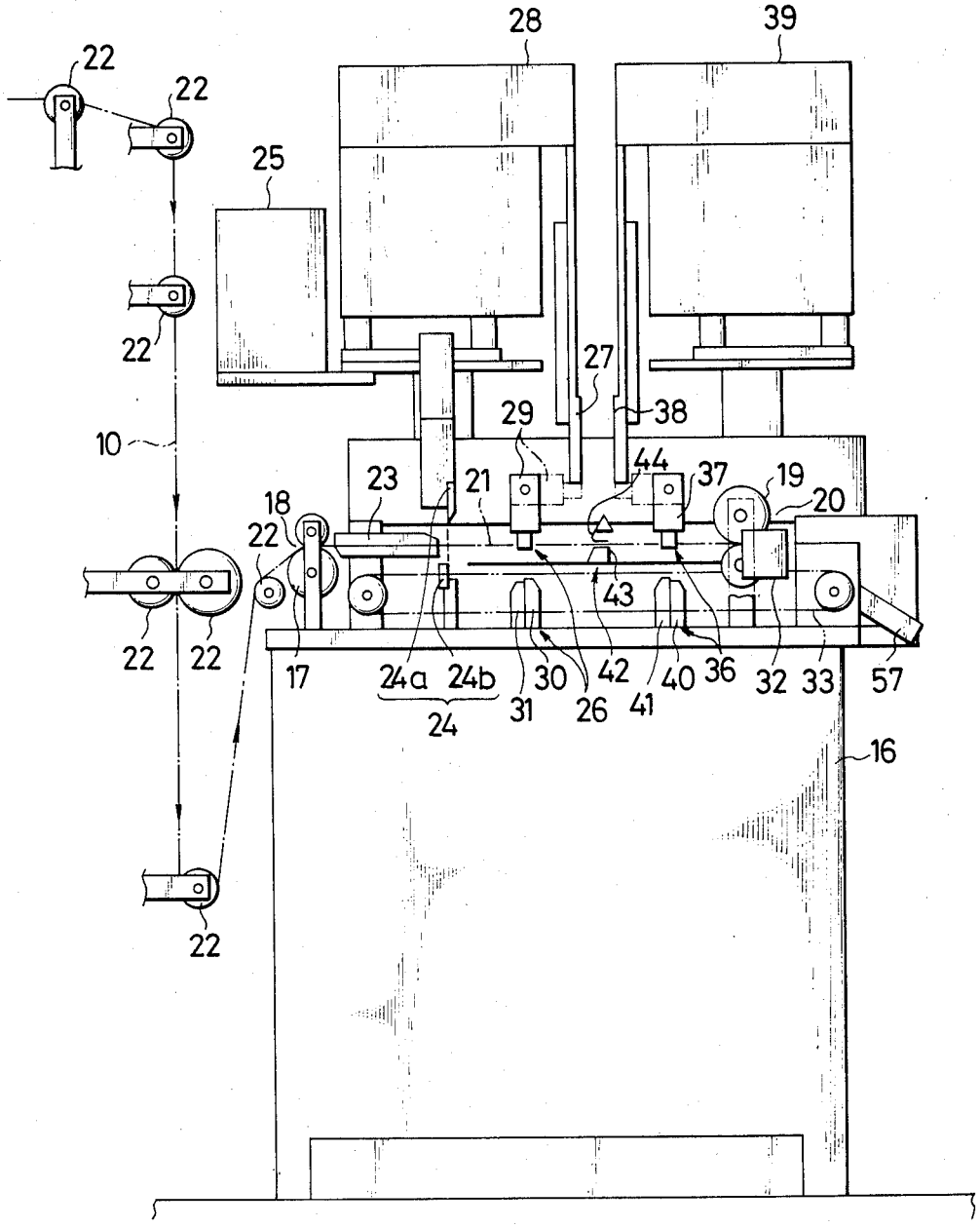
FIG. 1 is a side elevational view of an apparatus embodying the present invention, schematically illustrating the layout of its operating units.
Figure 3:
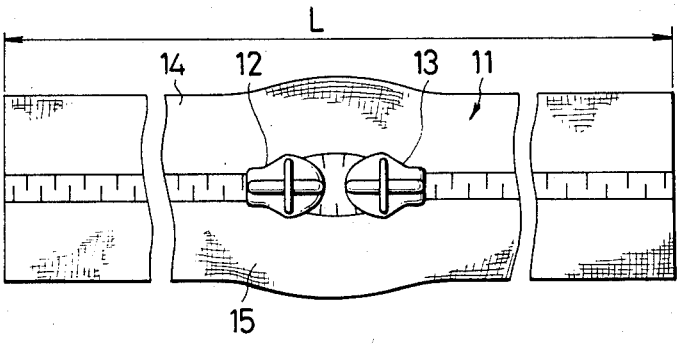
FIG. 3 is a fragmentary plan view of a slide fastener having a pair of sliders applied in accordance with the invention.

FIG. 1 shows the general layout of the various operating units and parts which constitute an apparatus of the invention for automatically applying pairs of sliders successively onto individual product lengths of a continuous slide fastener chain 10 and cutting off the individual lengths successively from the slide fastener chain 10, thus producing bidirectionally openable slide fasteners. Each of the slide fasteners 11 thus produced, as shown in FIG. 3, has a pair of oppositely directed sliders 12, 13 mounted on a pair of stringer tapes 14, 15 and movable independently to open the slide fastener 11 in opposite directions.

As shown in FIG. 1, the apparatus comprises a frame 16 on which are mounted a metering feed roller 17 at a first or input end 18 and a discharge roller 19 at the other or output end 20 of the feed of the slide fastener chain 10. The fastener chain 10 is fed from a supply source (not shown) through a series of guide rolls 22 past the metering roller 17 to a chain guide block 23 disposed on the feed path 21 immediately downstream of the input end 18. A cutter unit 24 is disposed immediately downstream of the guide block 23 and includes a cooperating pair of upper and lower cutters **24*a*, 24*b* vertically movable toward and away from each other across the feed path 21. The cutter unit 24 is actuated by a signal from a controller unit 25 which sets a predetermined length L of each individual fastener product 11 (FIG. 3) to be measured by the metering feed roller 17 and cut by the cutter unit 24**.

Disposed downstream of the cutter unit 24 is a first slider attachment unit 26 which is so constructed as to first receive a first slider (identical with the slider 12 shown in FIG. 3) from a chute 27 connected to a first parts feeder 28, then transfer the received first slider 12 into the fastener-chain feed path 21, and thereafter thread the first slider 12 over a pair of stringer tapes (identical to the stringer tapes 14, 15 shown in FIG. 3) of the slide fastener chain 10. The first slider attachment unit 26 includes a slider feeder 29 angularly movable between a first horizontal position (indicated by phantom lines) for receiving the slider 12 from the chute 27 and a second vertical position (indicated by solid lines) for supporting the slider 12, and a slider stopper 30 and a slider arrester 31 which are disposed in parallel juxtaposition below the slider feeder 29 for releasably retaining the slider 12 received from the slider feeder 29. The slider stopper 30 and the slider arrester 31 are vertically movable toward and away from the feed path 21. This slider attachment unit 26 is substantially the same as the slider attachment unit disclosed in Japanese Patent Laid-open Publication No. 60-236604 and hence will require no further description.

Figure 2:
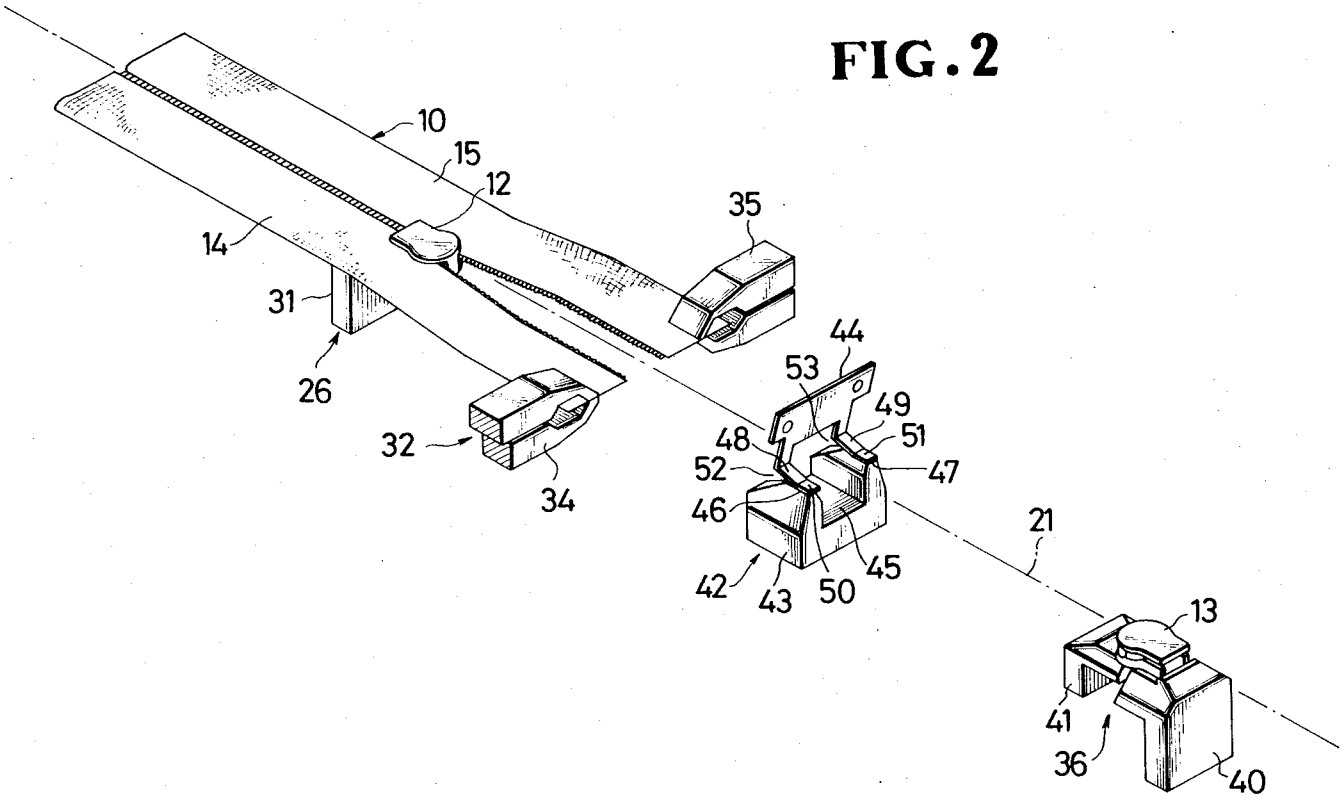
FIG. 2 is a perspective view of a portion of the apparatus of FIG. 1.

The apparatus also includes a fastener chain gripper 32 reciprocably movable, under the control of an endless drive belt 33, along the feed path 21 between the input end 18 and the output end 20 for feeding a length of the slide fastener chain 10 from the metering feed roller 17 to the discharge roller 19. The fastener chain gripper 32 includes a pair of oppositely disposed grip jaws 34, 35 for gripping the leading ends of the respective stringer tapes 14, 15 and moving the slide fastener chain 10 to thread the stringer tapes 14, 15 through the slider 12 while the latter is held on the first slider attachment unit 26, as shown in FIG. 2. This chain gripper 32 is also taught in the aforesaid Japanese patent publication and does not per se constitute any positive part of the invention.

A second slider attachment unit 36 is located downstream of the first slider attachment unit 26 in symmetric relation to the latter with respect to a vertical line so that a second slider (identical with the slider 13 shown in FIG. 3) is directed opposite to the first slider 12. The second slider attachment unit 36 is structurally and functionally identical to the first slider attachment unit 26 and includes a slider feeder 37 angularly movable between a first horizontal position to receive the second slider 13 supplied via a chute 38 from a second parts feeder 39 and a vertical position to transfer the received second slider 13 onto a slider stopper 40 and a slider arrester 41, in a manner already described in connection with the first slider attachment unit 26.

Disposed between the first and second slider attachment units 26, 36 is a guide unit 42 for holding taut the fastener chain 10 on assembling the second slider 13 thereon. The guide unit 42, as better shown in FIG. 2, comprises a lower guide member 43 secured to the frame 16 and an upper presser member 44 secured to the frame 16 in confronting relation to the guide member 43 across the feed path 21. The guide member 43 is composed of a block having a U-shaped guide channel 45 extending along the feed path 21 for the passage of the first slider 12, and a pair of parallel spaced guide surfaces 46, 47 extending along opposite slides of the guide channel 45 for guiding the stringer tapes 14, 15 as they are advanced along the feed path 21. The presser member 44 is formed of a generally U-shaped resilient sheet of metal and includes a pair of laterally spaced resilient legs 48, 49 bent into a multangular shape. The multangular resilient legs 48, 49 have a pair of horizontally extending presser feet 50, 51, respectively, overlying the guide surfaces 46, 47. The presser feet 50, 51 are spaced from the guide surfaces 46, 47 respectively by a small distance such that the stringer tapes 14, 15 are resiliently nipped therebetween. The resilient legs 48, 49 have a pair of inclined longitudinal portions extending upwardly from the presser feet 50, 51. On the other hand, the guide member 43 has a pair of inclined front surfaces extending downwardly from the respective guide surfaces 46, 47 so as to define jointly between the inclined leg portions a pair of substantially triangular guide spaces 52, 53 flaring toward the first slider attachment unit 26.

FIGS. 4A–4E inclusive are utilized to explain the manner in which first and second sliders 12, 13 are threaded successively over the slide fastener chain 10 in the course of the manufacture of bidirectionally openable slide fasteners having a length L which is shorter than the distance between the nip of the metering feed roller 17 and the second slider attachment unit 36. The slide fastener chain 10 is threaded through a first slider 12 held on the first slider attachment unit 26 as it is advanced by the gripper unit 32 until the leading end of the fastener chain 10 is located close to the guide spaces 36 (only one shown) in the second slider attachment unit 36 (FIG. 2A).

Figure 4A:
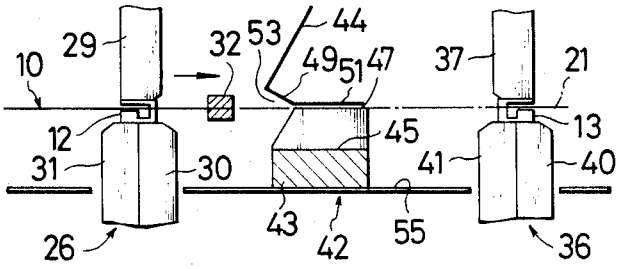
FIGS. 4A–4E inclusive are side elevational views, partly in cross section, of slider assembling units in the apparatus, showing the sequence of assembling a pair of sliders.
Figure 4B:
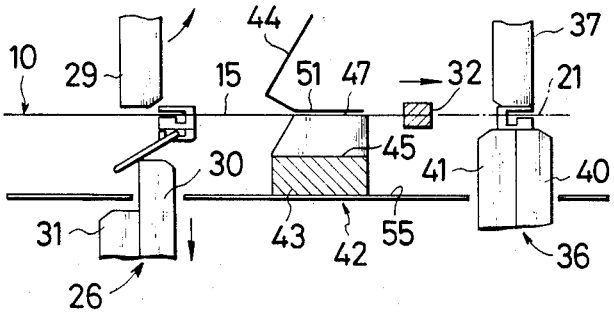

The first slider 12 is thereafter released from the first slider attachment unit 26 as the slider feeder 29, the slider stopper 30, and the slider arrester 31 are retracted away from the feed path 21. During that time, the chain gripper 32 continuously advances the fastener chain 10, causing the respective stringer tapes 15 (only one shown) of the fastener chain 10 to be forced into spaces between the presser feet 51 (only one shown) and the guide surfaces 47 (only one shown) of the guide unit 42, as shown in FIG. 4B. In this and the following drawing figures, the presser member 44 is shown as being separated from the slide fastener chain 10, but in practice, it is held in frictional contact with the slide fastener chain 10.

Figure 4C:
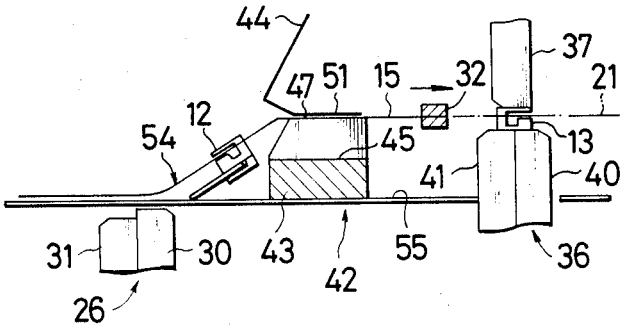

When the length of travel of the fastener chain 10 measured by the metering feed roller 17 becomes equal to the length L of the finished slide fastener, the cutter unit 24 (FIG. 1) is actuated to sever the fastener chain 10 into a pre-assembled or semi-finished fastener 54 of an individual product length L. Since the severed fastener length L is shorter than the distance between the nip of the metering feed roller 17 and the second slider attachment unit 36, the severed pre-assembled fastener 54 loses support and sags over a horizontal surface 55 of the frame 16 at its trailing end as shown in FIG. 4C. However, the pre-assembled fastener 54 is held taut over a length between the guide unit 42 and the chain gripper 32 as the resilient feet 51 continuously urges the stringer tapes 15 of the pre-assembled fastener 54 against the guide surfaces 47.

Figure 4D:
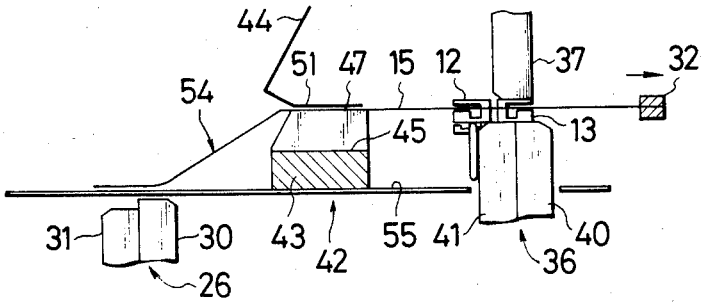
Figure 4E:
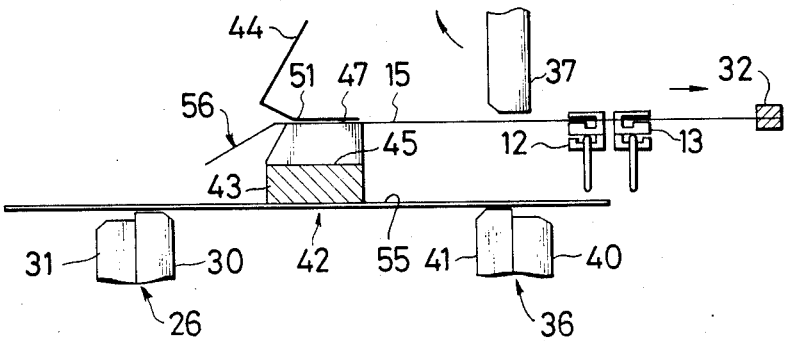

As the chain gripper 32 is further advanced along the feed path 21 from the position FIG. 4C to the position of FIG. 4D, the first slider 12 passes through the guide channel 45 in the guide member 43. The pre-assembled slide fastener 54 is drawn through the second slider attachment unit 36 under tension against the friction acting between the presser feet 51 and the stringer tapes 15 and also between the stringer tapes 15 and the guide surfaces 47, so that the second slider 13 can be smoothly threaded over the pre-assembled slide fastener 54.

Thereafter, the slider feeder 37, the slider stopper 40 and the slider arrester 41 are retracted away from the feed path 21 (FIG. 4E) to release the second slider 13, and then the assembled or finished slide fastener 56 is discharged by the discharge roller 19 (FIG. 1) from the output end 20 to a collector chute 57.

Obviously, many modifications and variations of the present invention are possible in the light of the above teaching. It is therefore to be understood that within the scope of the appended claims, the invention may be practiced otherwise than as specifically described.

What is claimed is:

1. An apparatus for manufacturing a bidirectionally openable slide fastener, of the type having a chain gripper reciprocably movable between an input end and an output end of said apparatus for feeding each individual fastener length of a continuous slide fastener chain along a feed path extending between the input and output ends, a cutter unit for cutting off the individual slide fastener length from the slide fastener chain, and a pair of spaced first and second slider attachment units for threading a pair of first and second sliders, respectively, over the individual slide fastener length, all the units being disposed in the feed path in the order named as viewed from the input end, the improvement which comprises a guide unit disposed on the feed path between the first and second slider attachment units for holding taut the individual slide fastener length as the latter is advanced along the feed path by the chain gripper, said guide unit including a guide member disposed on one side of the feed path and having a guide channel for the passage therethrough of the first slider, and a presser member disposed on the other side of the feed path in confronting relation to the guide member for urging the individual slide fastener length against the guide member.

2. An apparatus according to claim 1, said guide member including a pair of guide surfaces extending along opposite sides of said guide channel for supporting respectively thereon a pair of stringer tapes of the individual slide fastener length, said presser member including a pair of laterally spaced resilient legs for holding the fastener stringers resiliently against said guide surfaces.

3. An apparatus according to claim 2, each said resilient leg having a presser foot extending in parallel spaced relation to a corresponding one of said guide surfaces.

4. An apparatus according to claim 2, each said resilient leg being bent into a multangular shape and defining jointly with said guide member a generally triangular guide space flaring toward the first slider attachment unit.

5. An apparatus according to claim 1, said feed path being horizontal, said guide member being disposed below said presser member.

* * * * *